US012024396B2

(12) United States Patent
Beldi' et al.

(10) Patent No.: US 12,024,396 B2
(45) Date of Patent: Jul. 2, 2024

(54) MACHINE AND METHOD FOR PROVIDING ROLLS OF MATERIAL FOR USE IN SHEET FORM, PARTICULARLY ALUMINUM FOR FOOD USES, OF THE CORELESS TYPE

(71) Applicant: IMS TECHNOLOGIES S.P.A., Calcinate (IT)

(72) Inventors: Alberto Beldi', Borgo Ticino (IT); Cesare Cornalba, Bollate (IT)

(73) Assignee: IMS TECHNOLOGIES S.P.A., Calcinate (IT)

( * ) Notice: Subject to any disclaimer, the term of this patent is extended or adjusted under 35 U.S.C. 154(b) by 362 days.

(21) Appl. No.: 17/253,313

(22) PCT Filed: Apr. 10, 2019

(86) PCT No.: PCT/EP2019/059136
§ 371 (c)(1),
(2) Date: Dec. 17, 2020

(87) PCT Pub. No.: WO2019/242903
PCT Pub. Date: Dec. 26, 2019

(65) Prior Publication Data

US 2021/0253392 A1 Aug. 19, 2021

(30) Foreign Application Priority Data

Jun. 20, 2018 (IT) ..... 102018000006478

(51) Int. Cl.
*B65H 75/24* (2006.01)

(52) U.S. Cl.
CPC ..... *B65H 75/2484* (2021.05); *B65H 2301/41354* (2013.01); *B65H 2301/41429* (2013.01);

(Continued)

(58) Field of Classification Search
CPC ..... B65H 75/2484; B65H 2301/41429; B65H 2701/18422
See application file for complete search history.

(56) References Cited

U.S. PATENT DOCUMENTS 180,169 A * 7/1876 Tasker ..... B23B 31/40 279/2.13
1,259,163 A * 3/1918 Sundh ..... B65H 75/2484 474/54

(Continued)

FOREIGN PATENT DOCUMENTS

CN 1183515 A 6/1998
CN 2561752 Y 7/2003

(Continued)

OTHER PUBLICATIONS

Chinese Office Action dated Jun. 24, 2022 received in Chinese Patent Application No. 201980041868.7, together with an English-language translation.

(Continued)

*Primary Examiner* — William A. Rivera
(74) *Attorney, Agent, or Firm* — Scully, Scott, Murphy & Presser, P.C.

(57) ABSTRACT

A method for providing rolls of material for use in sheet form, particularly aluminum for food uses, comprising a step of rewinding the material for use in sheet form in order to form a roll; the rewinding step is provided by winding the material for use in sheet form directly on a rewinding shaft, with the material for use in sheet form in contact with a cylindrical outer lateral surface of the rewinding shaft, which is actuated with a rotary motion about its longitudinal axis, so as to obtain a coreless roll.

9 Claims, 12 Drawing Sheets

(52) U.S. Cl.
CPC ..... *B65H 2301/51533* (2013.01); *B65H 2406/334* (2013.01); *B65H 2701/1732* (2013.01); *B65H 2701/18422* (2013.01); *B65H 2701/1944* (2013.01)

(56) References Cited

U.S. PATENT DOCUMENTS

| | | | | | |
|---|---|---|---|---|---|
| 2,280,370 | A * | 4/1942 | Bennett | B65H 75/2484 | 242/573.1 |
| 2,394,503 | A * | 2/1946 | Wilson | B21C 47/30 | 242/576.1 |
| 3,848,824 | A * | 11/1974 | Van Schijndel | B65H 19/2223 | 242/533.1 |
| 5,344,091 | A | 9/1994 | Molison | | |
| 5,660,349 | A * | 8/1997 | Miller | B65H 19/2223 | 242/532.2 |
| 2005/0224627 | A1* | 10/2005 | Stolyar | B65H 16/103 | 242/571.6 |
| 2007/0084958 | A1* | 4/2007 | Daul | B65H 19/283 | 242/531 |
| 2016/0060061 | A1* | 3/2016 | Macura | B65H 19/126 | 242/559 |
| 2018/0162669 | A1* | 6/2018 | Provera | B65H 19/2223 | |

FOREIGN PATENT DOCUMENTS

| | | | |
|---|---|---|---|
| CN | 206798756 | U | 12/2017 |
| CN | 207209545 | U | 4/2018 |
| CN | 108002138 | A | 5/2018 |
| EP | 2660173 | A1 | 11/2013 |
| JP | 2004-161478 | A | 6/2004 |
| JP | 2014161478 | A | 9/2014 |
| WO | WO 2018/024335 | A1 | 2/2018 |

OTHER PUBLICATIONS

International Search Report and Written Opinion dated Jun. 12, 2019 issued in PCT/EP2019/059136.

Italian Search Report and Written Opinion dated Feb. 14, 2019 issued in IT 201800006478.

* cited by examiner

MACHINE AND METHOD FOR PROVIDING ROLLS OF MATERIAL FOR USE IN SHEET FORM, PARTICULARLY ALUMINUM FOR FOOD USES, OF THE CORELESS TYPE

The present invention relates to a machine and a method for providing rolls of material for use in sheet form, particularly aluminum for food uses.

As is known, aluminum rolls used for food uses (for wrapping and preserving food) are formed by a thin sheet of aluminum alloy, wound on a rigid cardboard core.

The rigid cardboard core is provided by winding multiple strips of paper in a spiral and pasting the layers together in order to provide the required rigidness and consistency.

The rigid core has in fact the function of supporting and protecting the aluminum sheet, which is very thin (9 to 23 microns) and fragile.

The current technique for producing aluminum sheet rolls thus provides for the use of rewinding machines (rewinders) that use feed rolls of aluminum sheet and rigid cardboard cores produced on other machines and subsequently loaded onto the rewinding machines.

Solutions are also known in which the rigid cardboard cores are produced directly on the rewinding machine by unwinding the cardboard sheet from a respective roll and winding it preliminarily on the same rewinding shaft on which the aluminum sheet is wound.

The aluminum sheet is thus unwound from the feed roll and rewound on the rigid cardboard cores up to the desired length.

The presence of the rigid cardboard core gives the product the necessary consistency in order to be packaged, transported and finally used by the end user until it is depleted.

The use of rigid cardboard cores, however, entails a considerable effort in the production process of aluminum sheet rolls, since these rigid cardboard cores:

- have to be manufactured and procured;
- require large storage spaces;
- require a significant use of workforce for feeding to the rewinder;
- create confusion in the production department;
- generate cardboard dust;
- have a high cost, if compared with the cost of the aluminum sheet;
- finally, have to be disposed correctly by the end user of the roll.

The aim of the present invention is to propose a method and a machine for providing rolls of material for use in sheet form, particularly aluminum for food uses, capable of solving the problems mentioned above.

Within this aim, an object of the invention is to provide a method and a machine that allow to produce rolls of material for use in sheet form, particularly aluminum for food uses, that have a practicality in use comparable with that of currently commercially available rolls.

Another object of the invention is to provide a method and a machine that allow to reduce considerably the use of workforce for the production of the rolls.

A further object of the invention is to provide a method and a machine for providing rolls of material for use in sheet form that are easier to provide and economically competitive if compared with those of the background art.

Another object of the invention is to provide a method and a machine that allow to produce rolls of material for use in sheet form that allow to reduce the environmental impact by reducing waste production.

This aim, as well as these and other objects that will become better apparent hereinafter, are achieved by a machine for providing rolls of material for use in sheet form, particularly aluminum for food uses, comprising:

- at least one substantially cylindrical rewinding shaft, which can be actuated with a rotary motion about a longitudinal axis thereof in order to perform a step of rewinding said material for use in sheet form and
- means for feeding the material for use in sheet form which can be actuated in order to feed the rewinding shaft with the material for use in sheet form to be wound;
- characterized in that said at least one rewinding shaft comprises a plurality of cylindrical sectors which are arranged circumferentially around said longitudinal axis and form an outer lateral surface of the rewinding shaft which is adapted to make contact with said material for use in sheet form during said winding step;
- said cylindrical sectors comprising fixed cylindrical sectors alternated with retractable cylindrical sectors;
- said retractable cylindrical sectors being movable radially toward and away with respect to said longitudinal axis, by the action of an actuation cam accommodated in said rewinding shaft, between:
- an expanded position, in which said retractable cylindrical sectors and said fixed cylindrical sectors are arranged flush, so as to form a cylindrical and substantially uniform outer lateral surface of the rewinding shaft and
- a retracted position, in which said retractable cylindrical sectors are arranged more internally with respect to said expanded position, so that longitudinal depressions 91 are formed along said outer lateral surface of the rewinding shaft.

This aim and these and other objects are also achieved by a method for providing rolls of material for use in sheet form, particularly aluminum alloy for food uses, comprising a step of rewinding the material for use in sheet form in order to form a roll,

- characterized in that said rewinding step is provided by winding said material for use in sheet form directly on a rewinding shaft, with said material for use in sheet form in contact with a cylindrical outer lateral surface of said rewinding shaft, which is actuated with a rotary motion about the longitudinal axis thereof, so as to obtain a coreless roll.

Further characteristics and advantages of the invention will become better apparent from the description of a preferred but not exclusive embodiment, of the method and of the machine according to the invention, illustrated by way of non-limiting example in the accompanying drawings, wherein.

Figure 1:
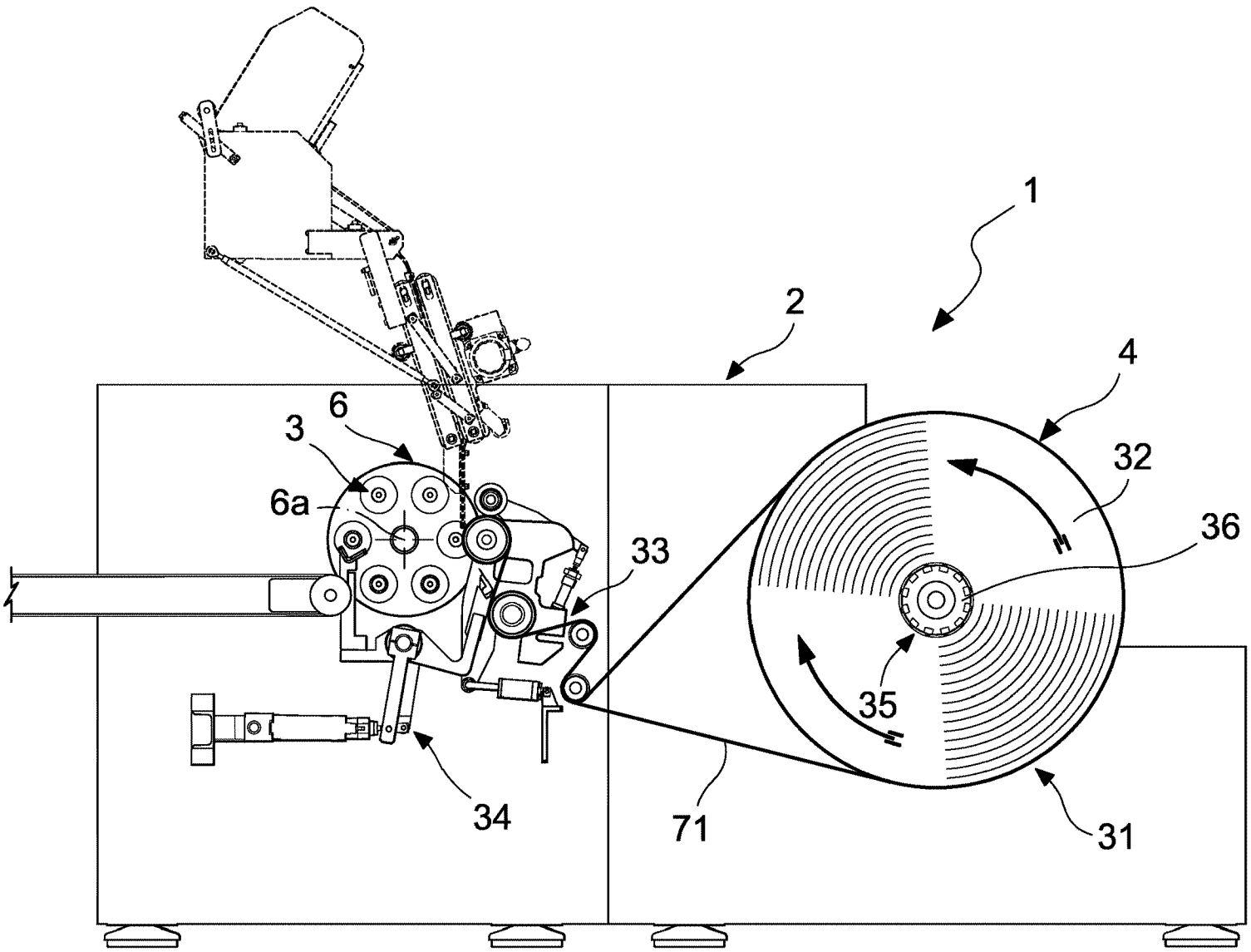
FIG. 1 is a schematic view of the machine according to the invention.

With reference to the figures, the machine according to the invention, generally designated by the reference numeral 1, comprises a supporting structure 2 that can be rested on the ground and supports at least one substantially cylindrical rewinding shaft 3, which can be actuated with a rotary motion about its longitudinal axis 3*a* in order to perform a step of rewinding the material for use in sheet form 71, constituted preferably by aluminum and even more preferably by an aluminum alloy for food uses, as will become better apparent hereinafter.

Figure 14:
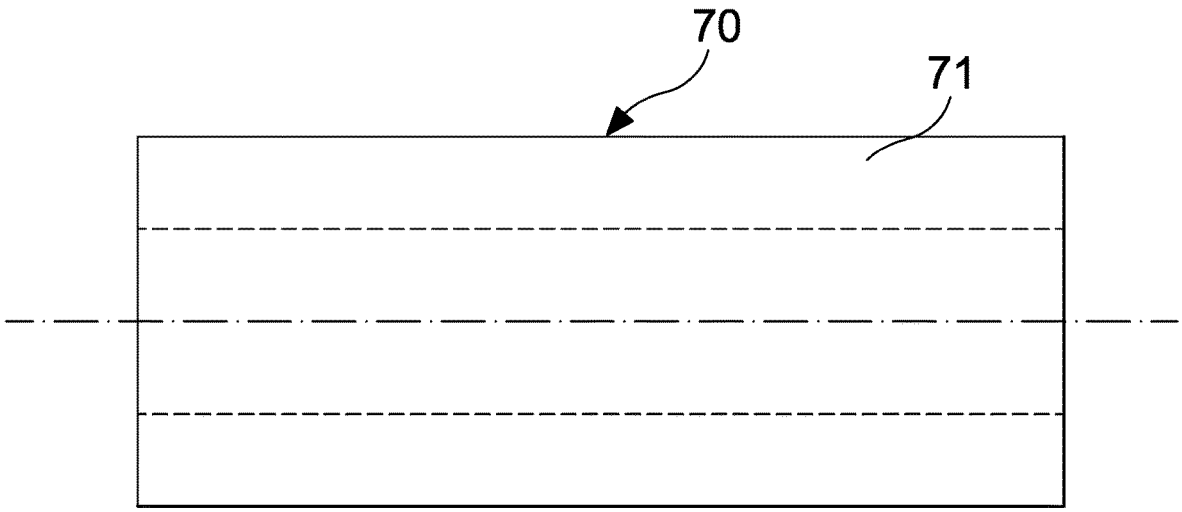
FIG. 14 is a lateral elevation view of a roll of material for use in sheet form.
Figure 15:
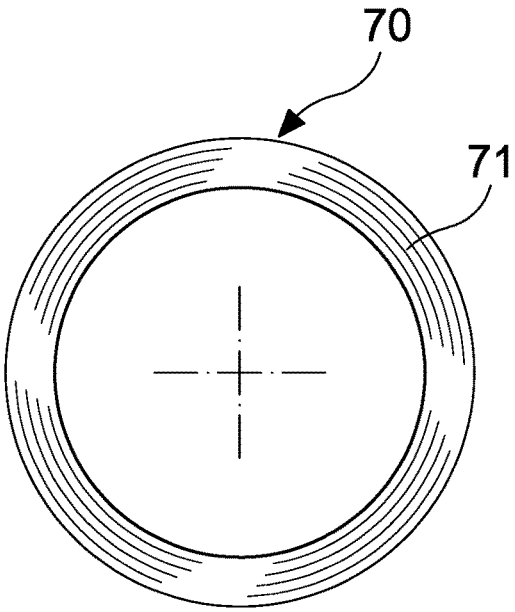
FIG. 15 is an axial end view of the same roll of FIG. 14.

The machine 1 comprises, moreover, means 4 for feeding the material for use in sheet form 71 which can be actuated in order to supply the rewinding shaft 3 with the material for use in sheet form 71 to be wound around the rewinding shaft 3 in order to provide the roll 70, illustrated in particular in FIGS. 14 and 15, as will be described better hereinafter.

For greater clarity, in the present description, the expression "material for use in sheet form" is used to identify the material of a roll 70 that is usable by the end user, such as for example the sheet of aluminum, or rather aluminum alloy, that is used for packaging food products.

Preferably, there is a plurality of rewinding shafts 3 which are supported by a revolver-like structure 6 having a horizontal (longitudinal) main axis 6*a*. In the embodiment shown, there are six rewinding shafts 3, which are evenly distributed around the main axis 6*a* and are arranged with their longitudinal axis 3*a* parallel to said main axis 6*a*.

In other possible embodiments, not shown, the rewinding shafts 3 are present in a different number, according to the requirements.

Figure 5:
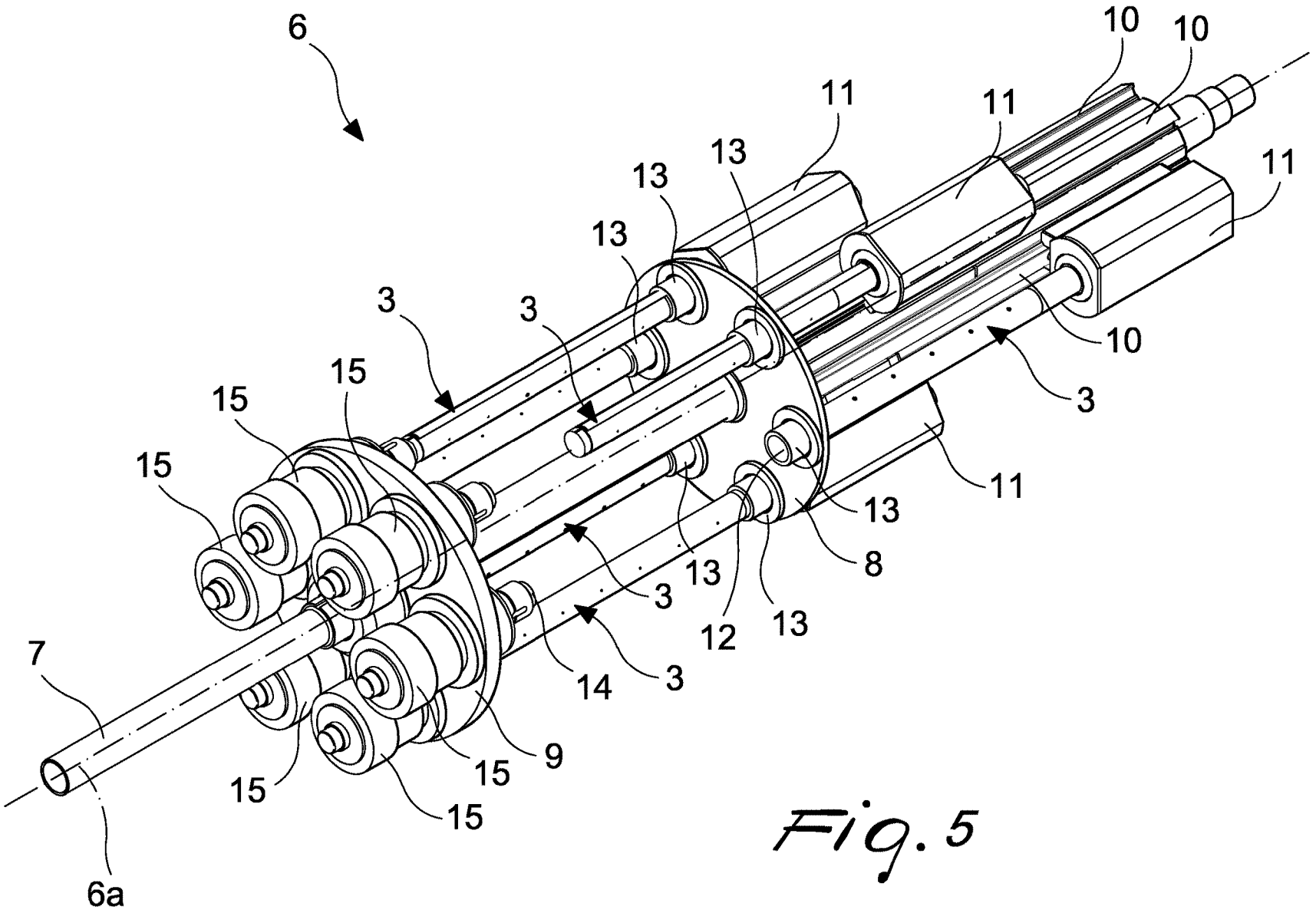
FIG. 5 is a perspective view of a revolver-like structure supporting multiple rewinding shafts.
Figure 6:
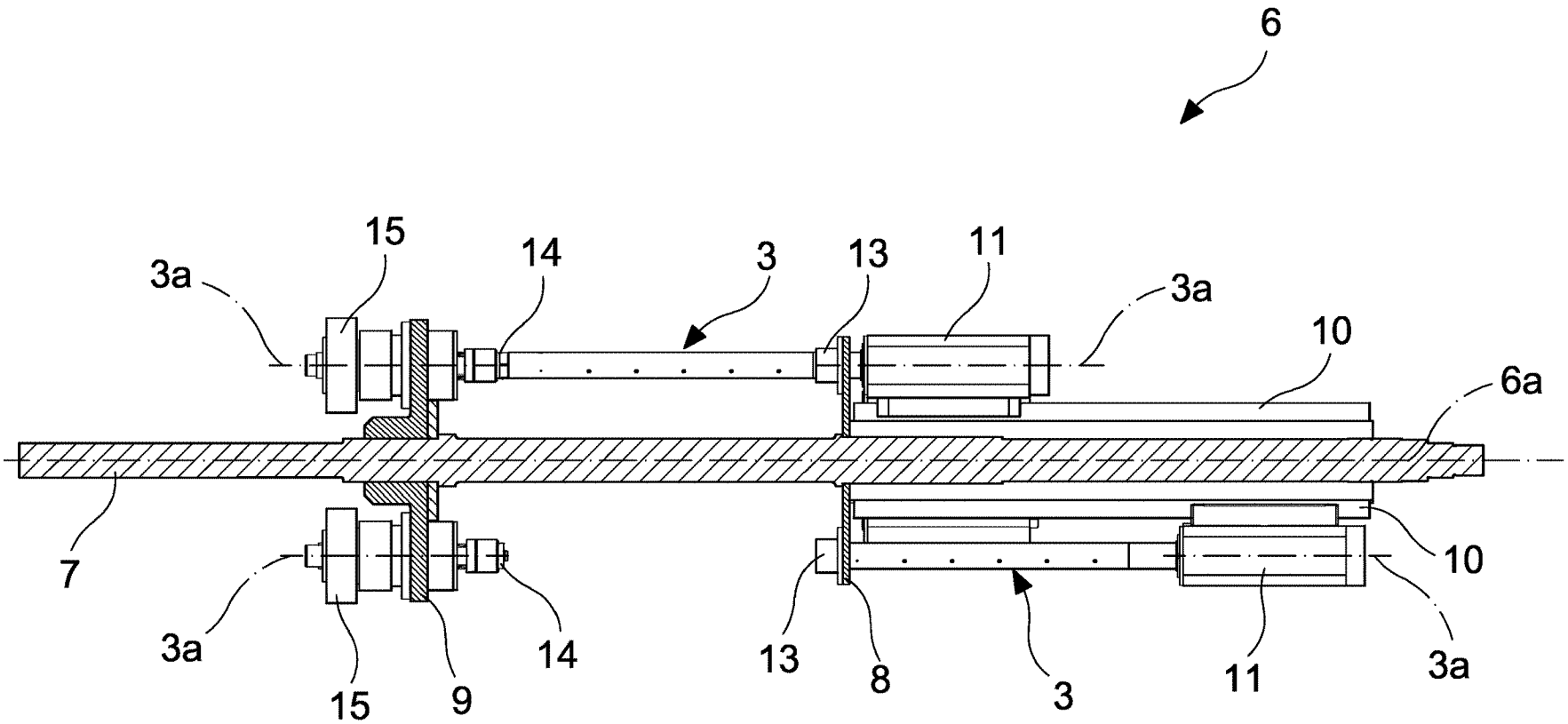
FIG. 6 is an axially sectional view of said revolver-like structure.
Figure 7:
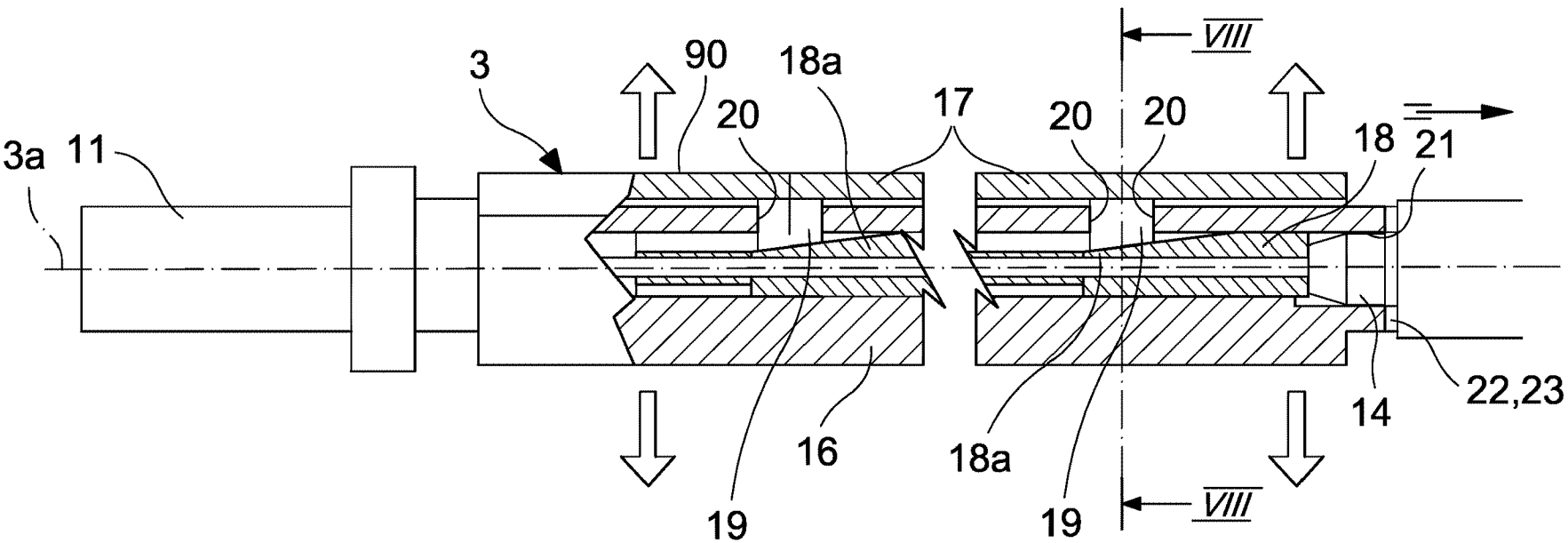
FIG. 7 is an axially sectional view of a rewinding shaft in an operating condition.

As shown in particular in FIGS. 5 and 6, the revolver-like structure 6 is composed substantially of a main shaft 7, the axis of which defines the main axis 6*a* of the revolver-like structure 6, and of two disks 8, 9, which are coaxially fixed to the main shaft 7 and are mutually spaced. Outside the region delimited by these two disks 8, 9, laterally to the disk 8, sliding guides 10 are fixed to the main shaft 7 and extend parallel to the main axis 6*a*. Each one of the rewinding shafts 3 is fixed, with one of its axial ends, to a slider 11 which engages slidingly one of said guides 10 and can be actuated in order to slide along the corresponding guide 10. Each rewinding shaft 3 passes through a hole 12 formed in the disk 8. An extraction ring 13 is arranged around said hole 12, on the side of the disk 8 that directed oppositely with respect to the corresponding slider 11.

The other disk 9 supports a plurality of tailstocks 14, one for each rewinding shaft 3. Each tailstock 14 is arranged on the side of disk 9 that is directed toward the disk 8 and is coaxial to the corresponding rewinding shaft 3.

Each tailstock 14 is connected to a corresponding pulley 15, which is arranged on the opposite side of the disk 9. The pulleys 15 are connected, in a per se known manner, to corresponding motors which are fixed with their body to the supporting structure 2 and can be actuated to cause the rotation of the tailstocks 14 about the corresponding axis that coincides with the longitudinal axis 3*a* of the corresponding rewinding shaft 3.

Each rewinding shaft 3 is supported, so that it can rotate about its longitudinal axis 3*a*, by the corresponding slider 11, and can be actuated with a rotary motion about its own longitudinal axis 3*a* following the engagement of its axial end, which is opposite with respect to the axial end connected to the corresponding slider 11, with the corresponding tailstock 14. In practice, by means of the sliding of each slider 11 along the corresponding guide 10 it is possible to engage or disengage the corresponding rewinding shaft 3 with respect to the corresponding tailstock 14.

Again by means of the sliding of each slider 11 along the corresponding guide 10, it is possible to move the corresponding rewinding shaft 3 almost entirely outside the space delimited by the disks 8, 9 in order to perform the unloading of the finished roll 70, as it will be better described hereinafter.

According to the invention, each rewinding shaft 3 comprises a plurality of cylindrical sectors 17, 16 that extend longitudinally along the longitudinal axis 3*a* and are arranged circumferentially around the longitudinal axis 3*a* (i.e., arranged in practice along one or more circumferences centered on the longitudinal axis 3*a*).

These cylindrical sectors 16, 17, which are arranged mutually adjacent and preferably spaced by the minimum possible space in order to allow their mutual movement, define the outer lateral surface 90 of the rewinding shaft 3. In greater detail, the outer lateral surface 90 is, at least during the rewinding step, a cylinder that has a circular cross-section and is adapted to make contact with the material for use in sheet form 71. In fact, according to the invention, the rewinding step is provided by winding the material for use in sheet form 71 directly on the rewinding shaft 3, in contact with its outer lateral surface 90.

Considering in greater detail the rewinding shaft 3, with particular reference to FIGS. 8, 9, 11 and 12, the cylindrical sectors 17, 16 comprise fixed cylindrical sectors 16 alternated with retractable or radially movable cylindrical sectors 17.

Preferably, the fixed cylindrical sectors 16 are mutually rigidly connected, so as to form a single element that acts as a supporting core of the rewinding shaft 3 and the axis of which defines the axis 3*a* of the corresponding rewinding shaft 3, and are mutually angularly equidistant.

The retractable cylindrical sectors 17 are arranged in the spaces formed between one fixed cylindrical sector 16 and the other and are radially movable toward or away with respect to the longitudinal axis 3*a*.

The radial movement of the retractable cylindrical sectors 17 can be provided by virtue of the action of an actuation cam 18 accommodated inside the rewinding shaft.

In the example shown, there are three fixed cylindrical sectors 16 alternated with three retractable cylindrical sectors 17 and each one of the six cylindrical sectors 16, 17 defines, along the outer lateral wall, in cross-section, a circumferential arc with a breadth of about 60°.

It is useful to specify that the elements referenced by the expression "cylindrical sector" are not to be intended as having necessarily the geometric shape of an exact cylindrical sector: for example, in the preferred and illustrated embodiment, the retractable cylindrical sectors 17 have a transverse cross-section shaped like a pseudo-parallelepiped with three bases which are rectilinear and at right angles to each other and the fourth base that is curved like a circumferential arc, the radius of which is that of the above mentioned cylinder with circular cross-section that constitutes the outer lateral surface 90.

Figure 11:
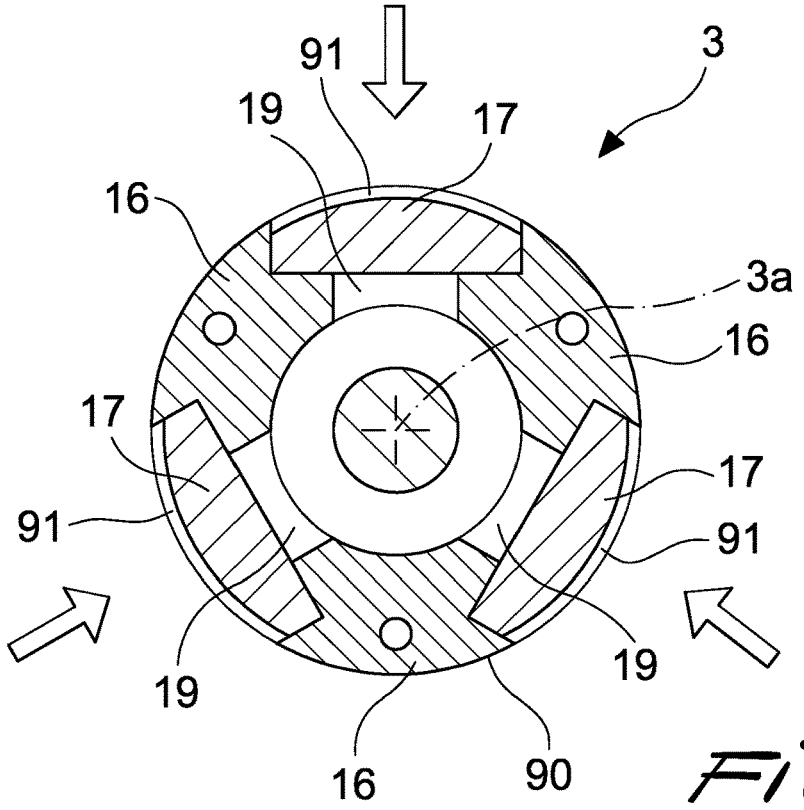
FIG. 11 is an enlarged-scale sectional view of FIG. 10, taken along the plane XI-XI.
Figure 12:
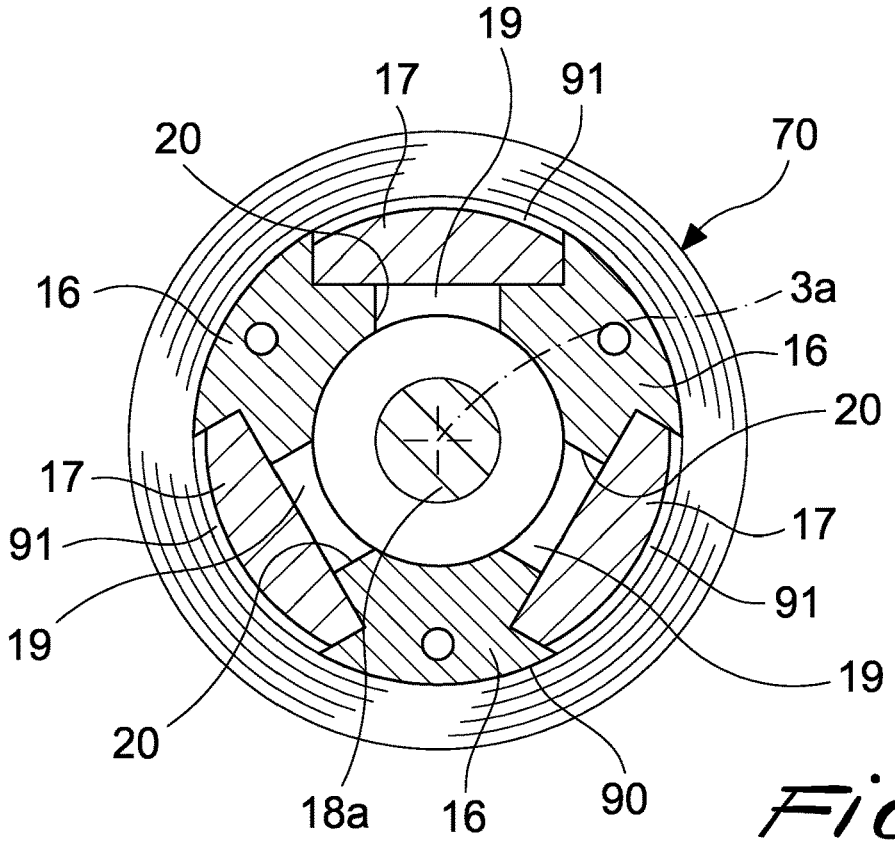
FIG. 12 is a view of the rewinding shaft as in FIG. 11 upon its disengagement from a roll.

In greater detail, the retractable cylindrical sectors 17 are radially movable between an expanded position (shown in FIGS. 8 and 9) and a retracted position (shown in FIGS. 11 and 12).

Figure 8:
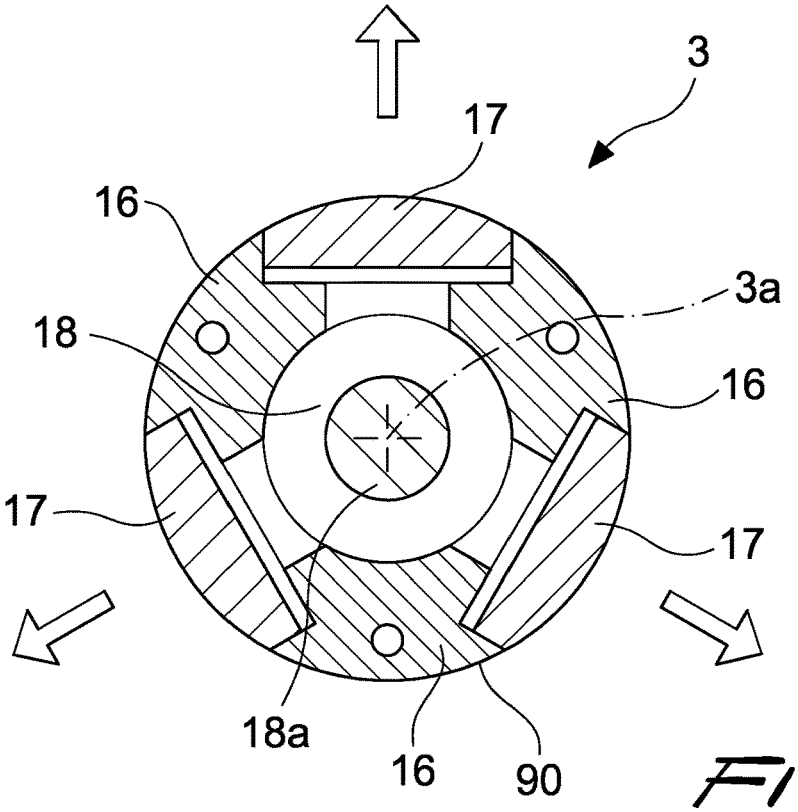
FIG. 8 is an enlarged-scale sectional view of FIG. 7, taken along the plane VIII-VIII.
Figure 9:
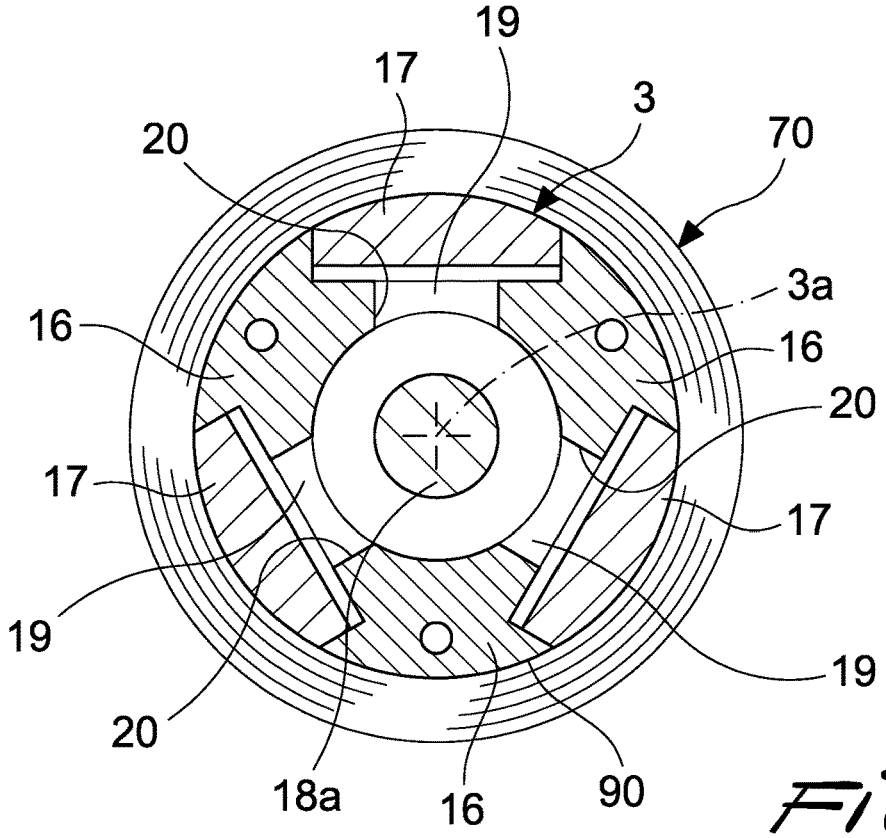
FIG. 9 is a view of the rewinding shaft as in FIG. 8 engaged with a roll.
Figure 10:
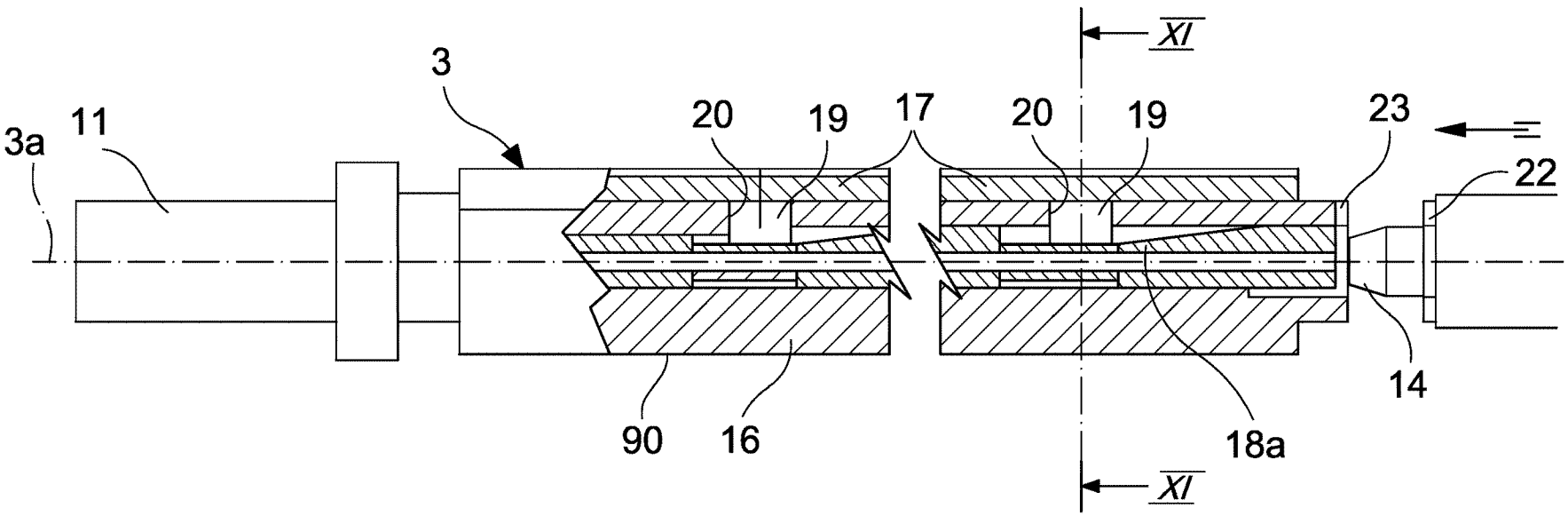
FIG. 10 is an axially sectional view of a rewinding shaft in another operating condition.

As is evident from FIGS. 8 and 9, in the expanded position the retractable cylindrical sectors 17 and the fixed cylindrical sectors 16 are arranged flush (i.e., with the outer surfaces aligned along a same ideal cylindrical surface), so as to form an outer lateral surface 90 of the rewinding shaft 3 which is cylindrical with a circular cross-section and is substantially uniform, i.e., in practice, interrupted only by the tiny interstices that are present between the adjacent cylindrical sectors 16, 17, having preferably the minimum width necessary to allow the radial movement of the retractable cylindrical sectors 17.

As is evident from FIGS. 11 and 12, in the retracted position the retractable cylindrical sectors 17 are arranged more internally (i.e., at a smaller radial distance from the longitudinal axis 3*a*) with respect to the expanded position, so that longitudinal depressions or grooves 91 are formed along the outer lateral surface 90 of the rewinding shaft 3.

In practice, the depth of the longitudinal depressions 91 that form when the retractable cylindrical sectors 17 are in the retracted position is equal to the radial movement performed by them starting from the expanded position.

Conveniently, the actuation cam 18 is configured to keep the retractable cylindrical sectors 17 in the expanded position at least during the winding step, so that the winding of the material for use in sheet form 71 occurs around the outer lateral surface 90 when it is cylindrical and substantially uniform.

The actuation cam 18 that guides the radial movement of the retractable cylindrical sectors 17, in the illustrated embodiment, is constituted by a shaft which is accommodated coaxially in the rewinding shaft 3, in the middle of the fixed cylindrical sectors 16, and is provided with conical portions 18*a* which are connected mechanically to the retractable cylindrical sectors 17 by means of pistons 19 that pass through radial passages 20 defined in the core constituted by the fixed cylindrical sectors 16 and act on the retractable cylindrical sectors 17. Said actuation cam 18 is axially movable with respect to the fixed cylindrical sectors 16 in order to perform the radial movement of the retractable cylindrical sectors 17 (i.e., to cause the retractable cylindrical sectors 17 to move closer or away with respect to the longitudinal axis 3*a* of the rewinding shaft 3) and therefore in order to perform the transition thereof from the retracted position to the expanded position (in practice, completing the outer lateral surface 90) and vice versa (in practice, interrupting the outer lateral surface).

The axial movement of the actuation cam 18 with reference to the fixed cylindrical sectors 16 is preferably performed by the engagement of the rewinding shaft 3 with the corresponding tailstock 14. In practice, when the rewinding shaft 3 is engaged, with one of its axial ends, with the corresponding tailstock 14, said tailstock 14 enters a seat 21 provided between the fixed cylindrical sectors 16 and engages an axial end of the actuation cam 18, pushing it axially toward the opposite end of the rewinding shaft 3 in contrast with the action of a spring, not shown in the figures, that is interposed between the fixed cylindrical sectors and the actuation cam 18.

According to an optional and advantageous feature, each rewinding shaft 3 is provided with suction channels, preferably oriented radially (being for example formed in the fixed cylindrical sectors 16), which perform the function of making material for use in sheet form 71 adhere to the outer lateral surface 90 of the rewinding shaft 3 by means of the application of a suction flow in a radial direction toward the longitudinal axis 3*a*.

In order to ensure connection, in rotation about the corresponding longitudinal axis 3*a*, of the tailstock 14 and the corresponding rewinding shaft 3, upon their mutual engagement, each tailstock 14 has a set of teeth 22 that can be engaged with a complementary set of teeth 23 provided on the end of the fixed cylindrical sectors of the corresponding rewinding shaft 3 that faces it.

Processing stations 25, 26, 27, 28, 29, 30 are arranged around the main axis 6*a* of the revolver-like structure 6 and the revolver-like structure 6 can be actuated, by virtue of means of the known type and not shown for the sake of simplicity, with an intermittent rotary motion about its own axis 6*a* in order to arrange, in each instance, one of the rewinding shafts 3 at one of the processing stations 25, 26, 27, 28, 29, 30.

Figure 13:
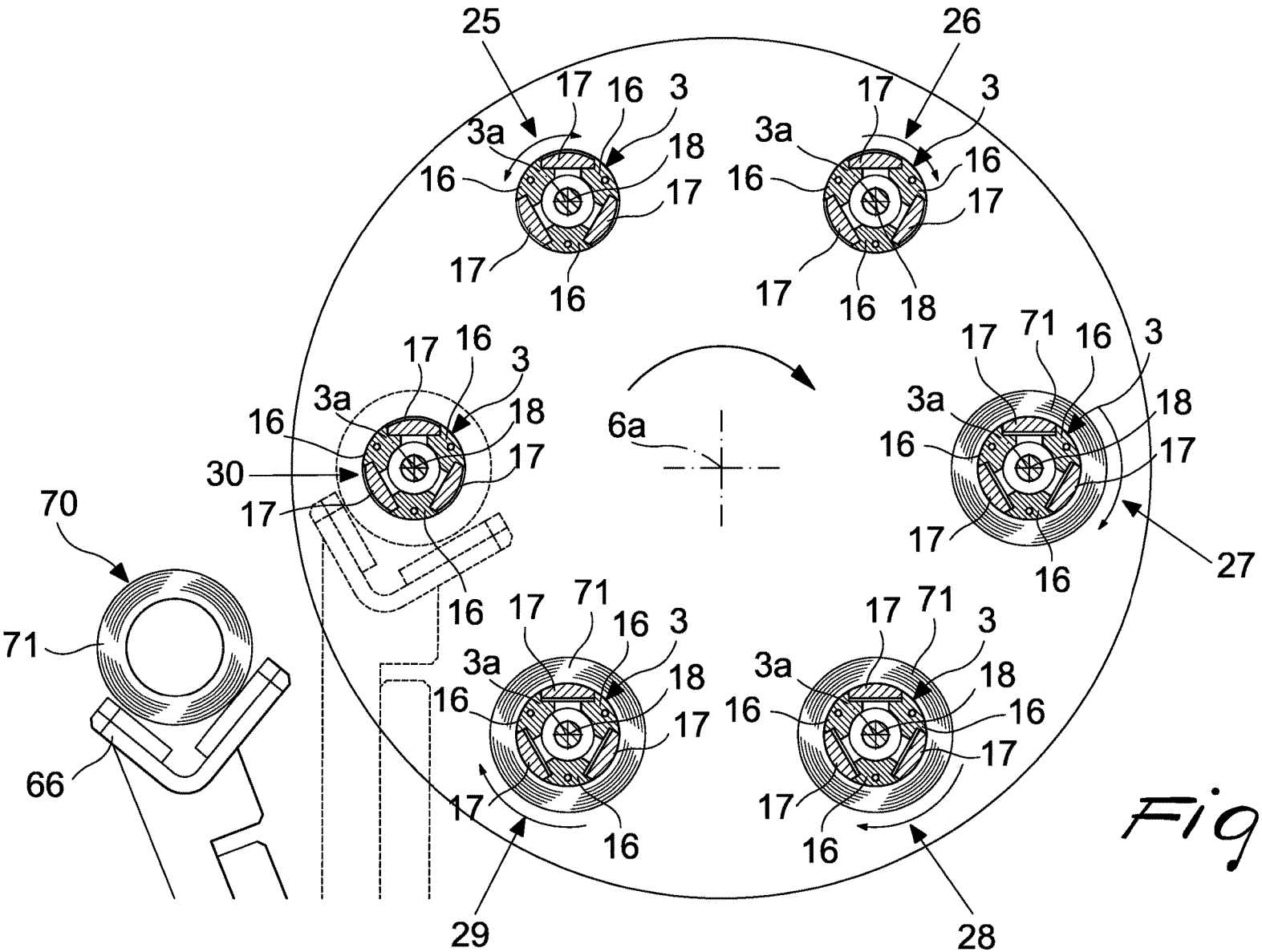
FIG. 13 is a schematic view of the processing stations of the revolver-like structure.

The processing stations 25, 26, 27, 28, 29, 30, as shown schematically in FIG. 13, comprise at least one station 27 for rewinding the material for use in sheet form 71 that is arranged sequentially around the main axis 6*a* of the revolver-like structure 6, along the direction of rotation of the revolver-like structure 6 about its own axis 6*a*.

More particularly, around the main axis 6*a* of the revolver-like structure 6 there are, in sequence: a first station 25 or station for setting up the rewinding shaft 3, a second station 26 or station for starting the rotation of the rewinding shaft 3, a third station 27 or station for rewinding the material for use in sheet form 71, a fourth station 28 or station for cutting the material for use in sheet form 71, a fifth station 29 or station for slowing down the rewinding shaft 3, and a sixth station 30 or station for unloading the finished roll 70 and optional labeling.

The feeder means 4 comprise means 31 for supporting a feed roll 32 of material for use in sheet form 71 and an assembly 33 for drawing the material for use in sheet form 71 which is arranged between the supporting means 31 and the rewinding station 27. Proximate to the fourth station 28 there are means 34 for cutting the material for use in sheet form 71.

More particularly, the supporting means 31 are constituted by an unwinding assembly 35 that has the function of supporting, in a per se known manner, a feed roll 32 of material for use in sheet form 71 and to allow its controlled (motorized or simply braked) unwinding.

The unwinding assembly 35 comprises, in a per se known manner, devices for supporting the feed roll 32 with an expansion shaft 36 or without a shaft, devices for motorizing or braking the feed roll 32, and protection devices for isolating the feed roll 32 during rotation. Said unwinding assembly 35 comprises, moreover, electrical and electronic devices and the command and control logic of the unwinding assembly 35, which have the purpose of adjusting and keeping under control the tension of the material for use in sheet form 71, during unwinding, as the outside diameter of the feed roll 32 varies.

Furthermore, the unwinding assembly 35 allows the operations for replacing the feed roll 32 to occur in very short times and in safe conditions.

Figure 2:
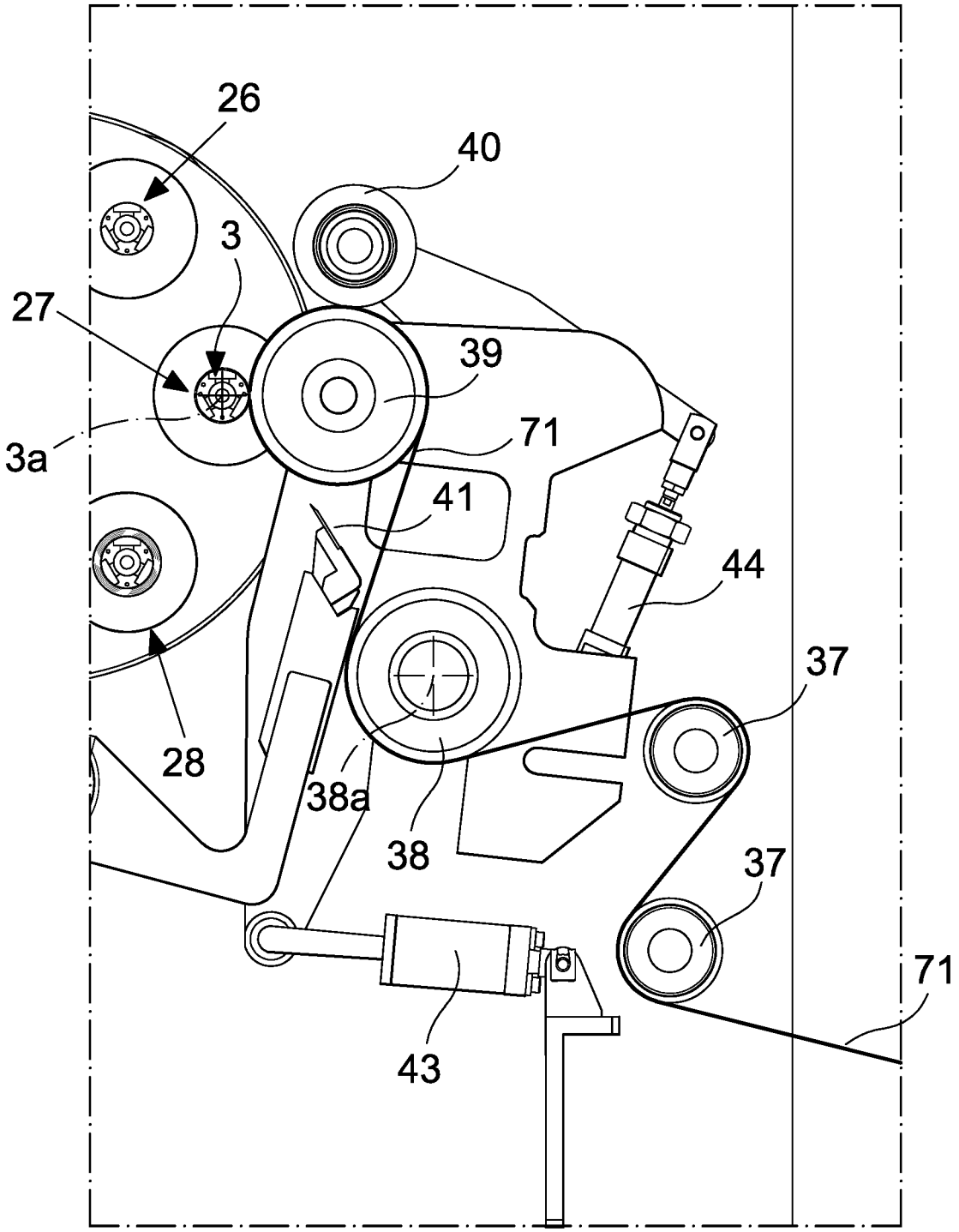
FIGS. 2 to 4 are enlarged-scale views of details of FIG. 1.

The drawing assembly 33, shown in particular in FIG. 2, has the function of drawing the material for use in sheet form 71 being unwound from the feed roll 32 to the third station 27 or rewinding station 27.

The drawing assembly 33 is formed, in a per se known manner, by a series of idle guiding rollers 37, by two motorized drawing rollers, a lower one 38 and an upper one 39, and by a presser roller 40.

The upper drawing roller 39 and the presser roller 40 are coupled to two oscillating shoulders 41 which, rotating about the axis 38*a* of the lower drawing roller 38 by virtue of the action of corresponding fluid-operated actuators 43, allow the rollers 39, 40 to adapt their position to the diameter of the roll 70 being rewound. Furthermore, the presser roller 40 is supported by two arms, which are pivoted to the oscillating shoulders 41 about an axis that is parallel to the axis 38*a*, and is pressed against the upper drawing roller 39 by the action of fluid-operated cylinders 44.

Figure 3:
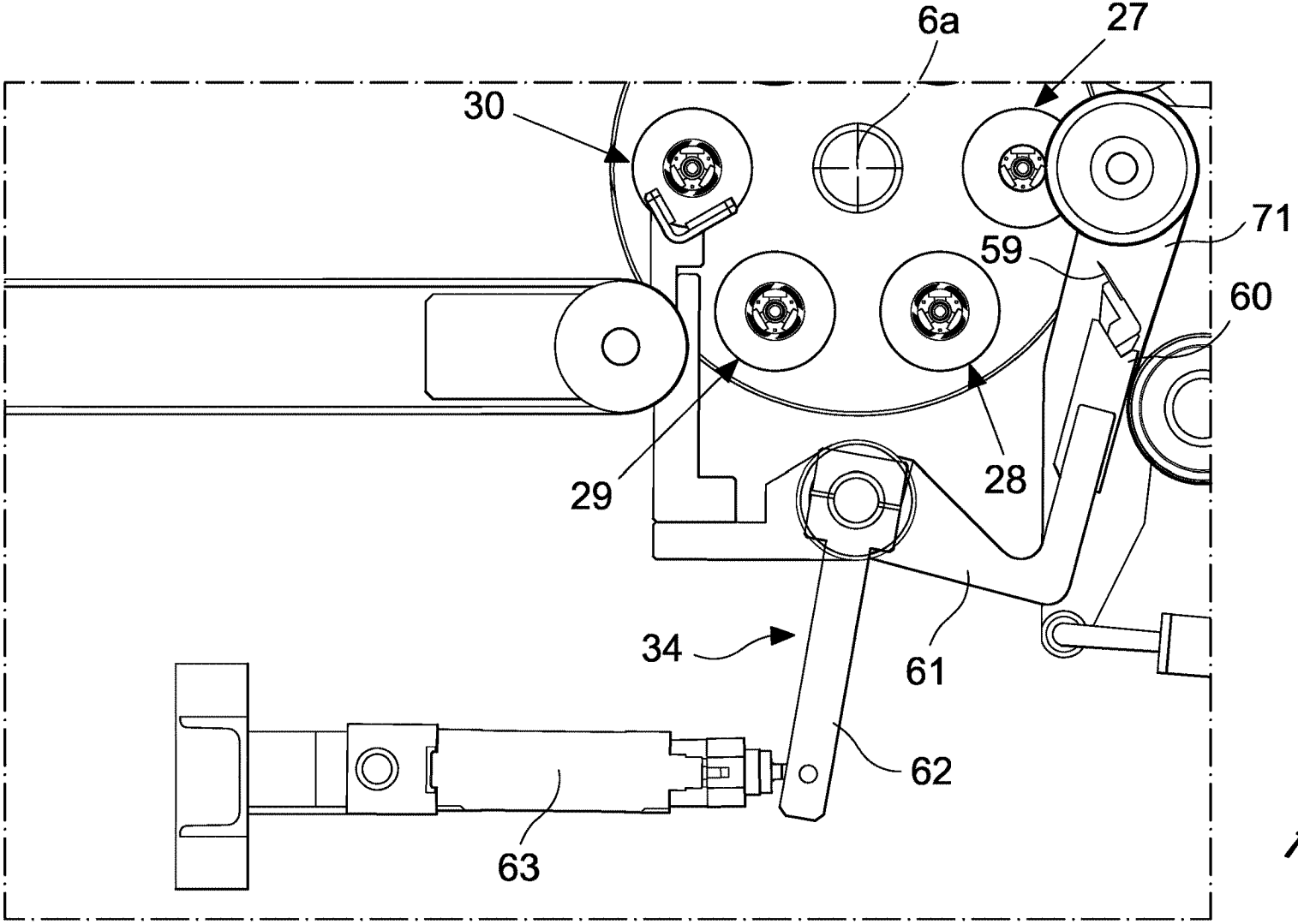

The cutting means 34, shown in particular in FIG. 3, perform the function of cutting the material for use in sheet form 71 to a length preset by the operator by means of the command and control device that supervises the operation of the machine.

The cutting means 34 comprise, in a per se known manner, a toothed blade 59 and electropneumatic devices for its actuation. The blade 59 comprises a nozzle 60 that has the task of dispensing a jet of laminar compressed air when the blade 59 makes contact with the material to be cut. The laminar compressed air cause the initial flap of the new roll to wind onto the following rewinding shaft 3, located in the rewinding station 27, immediately after the material for use in sheet form 71 has been cut to the preset length.

The blade 59 is mounted on a pair of linkages 61 with a device for adjusting the height of the blade 59. The devices for actuating the blade 59 comprise a lever 62 and a fluid-operated actuator 63.

Figure 4:
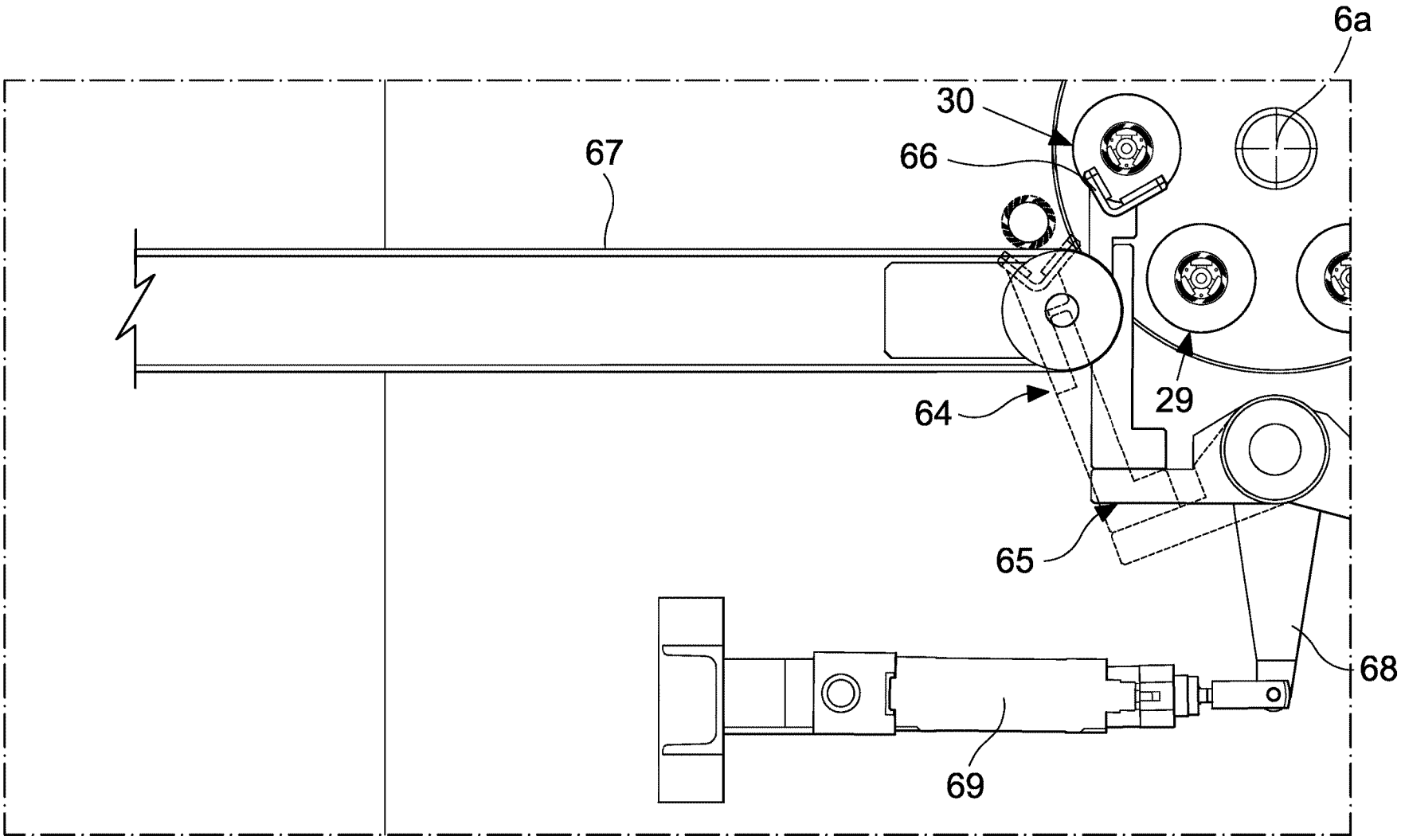

Conveniently, with particular reference to FIG. 4, proximate to the sixth station 30 there are unloading means 64 which comprise an assembly 65 for unloading the finished rolls, which has the function of extracting the finished roll 70 from the revolver-like structure 6 and of moving it outside the machine where it can be picked up by the operator or taken by adapted conveyor belts and transferred to the packaging machines.

The unloading assembly 65, shown in particular in FIG. 4, comprises an oscillating cradle 66 on which the roll 70 expelled by the rewinding shaft 3 is deposited, as will be described better hereinafter, and by an unloading belt 67.

The devices for actuating the oscillating cradle 66 comprise a lever 68 and a fluid-operated actuator 69.

The operation of the described machine, in the execution of the method according to the invention, is as follows.

Operation is described with reference to a rewinding shaft 3, starting from when said rewinding shaft 3 is arranged in the first station 25.

In this first station 25, the rewinding shaft 3, by means of the advancement of the slider 11, connected to one of its axial ends, toward the disk 8, causes the approach of the opposite axial end to the corresponding tailstock 14.

The revolver-like structure 6 is then actuated so as to place the rewinding shaft 3 at the second station 26. In this second station 26, the rewinding shaft 3, by means of the further advancement toward the disk 8 of the slider 11 connected to one of its axial ends, engages the corresponding tailstock 14 by means of the sets of teeth 22 and 23.

As already explained, this engagement between the tailstock 14 and the rewinding shaft 3 renders the rewinding shaft 3 integral with the tailstock 14 in rotation about their axis 3*a* with respect to the revolver-like structure 6 and, because of the axial thrust imparted to the actuation cam 18 by said tailstock 14, the radial expansion of the retractable cylindrical sectors 17 is caused, i.e., their transition to the expanded position already described and thus of the rewinding shaft 3 in the rewinding condition. In this condition, as already explained, since the cylindrical sectors 17 and 16 have as the whole an outside radius equal to that of the circumscribed circumference, the outer lateral surface 90 of the rewinding shaft 3 is perfectly cylindrical and uniform apart from the narrow interstices, present between the adjacent cylindrical sectors 16 and 17, that have the minimum width necessary to allow the radial movement of the retractable cylindrical sectors 17.

The revolver-like structure 6 is thus rotated so as to move the rewinding shaft 3 into the following rewinding station 27. During this transition, the rewinding shaft 3 is moved, by means of the actuation of the motor connected by means of the pulley 15 to the corresponding tailstock 14, at a rotation rate that corresponds to the linear speed of the material for use in sheet form 71 being unwound from the feed roll 32.

In the rewinding station 27, the front flap of the material for use in sheet form 71 is made to adhere to the outer lateral surface 90 of the rewinding shaft 3 and is then wound thereon. The adhesion of the front flap of the material for use in sheet form 71 to the rewinding shaft 3 can occur by means of the mechanical action of a guiding device, of a known type and not shown, i.e., without adhesive, or by means of suction at the adapted suction channels provided on the rewinding shaft 3.

Optionally, a single sheet, preferably made of paper, is inserted in the rewinding station 27 inside the first inner turns of the roll, by virtue of means of a known type (not shown). Said sheet can have advertising or warning functions and/or can have the function of stiffening the roll 70, ensuring, during its use, adequate rigidity even when only a few turns are left before the material for use in sheet form 71 is depleted.

Said single sheet can be inserted through a sheet insertion machine, shown in dotted lines in FIG. 1.

Once the rewinding of a preset length of material for use in sheet form 71 on the rewinding shaft 3 has finished, the revolver-like structure 6 is again rotated so as to bring the rewinding shaft 3 being considered in the fourth station 28 while another rewinding shaft 3 is placed in the third station 27 or rewinding station.

With the rewinding shaft 3 in the fourth station 28, the cutting means 34 are actuated and cut the material for use in sheet form 71 and, by means of the jet of air delivered by said first cutting means 34, the front flap of the material for use in sheet form 71 that has just been cut is pushed against the rewinding shaft 3 located in the third station 27.

The rewinding shaft 3 being considered is thus placed, by means of the rotation of the revolver-like structure 6 about its axis 6*a*, in the fifth station 29, where the rotation of the rewinding shaft 3 is slowed down progressively until it stops.

The rewinding shaft 3 is then placed, again following the rotation of the revolver-like structure 6 about its own axis 6*a*, in the sixth station 30, where the formed roll 70 is unloaded and moved away from the machine 1. More particularly, after the optional application of a self-adhesive label on the roll 70, the slider 11 is actuated along the corresponding guide 10, so as to cause the disengagement of the rewinding shaft 3 from the corresponding tailstock 14 and thus its progressive extraction from the region delimited by the disks 8, 9. The disengagement of the tailstock 14 causes the axial sliding of the actuation cam 18 with regard to the fixed cylindrical sectors 16 of the rewinding shaft 3 by virtue of the action of the spring, as already explained, and consequently the approach of the retractable cylindrical sectors 17 to the longitudinal axis 3*a* (i.e., the transition to the retracted position). In this manner, the retractable cylindrical sectors 17 disengage from the internal surface of the roll 70, creating the longitudinal depressions 91 that facilitate the passage of air that favors the uncoupling of the roll 70 from the rewinding shaft 3. Furthermore, the extraction of the rewinding shaft 3 from the region comprised between the two disk 8, 9 causes the extraction of said rewinding shaft 3, causing the fall of the roll 70 onto the oscillating cradle 66 placed below it. The extraction of the rewinding shaft 3 is facilitated by the presence of the extraction ring 13. The oscillating cradle 66 unloads the finished roll 70 from the machine, depositing it in a container or on a conveyor belt 67.

Subsequently, in the transition from the sixth station 30 to the first station 25, the rewinding shaft 3, by means of the actuation of the corresponding slider 11, is again moved toward the corresponding tailstock 14 and thus moved into the station 26, in which the retractable cylindrical sectors 17 are returned to the expanded position, and then in the rewinding station 27.

The operating cycle with respect to the rewinding shaft 3 being considered then resumes as already described.

It should be noted that the roll 70 that is obtained with the method and the machine according to the invention has no core, but by virtue of the devices for tensioning the material of the known type, not shown for the sake of simplicity, it has a rigidity that is sufficient to avoid damage during the subsequent packaging, transport and use steps.

In practice, with the machine and the method according to the invention, by virtue of the fact that cores are not used, the burden of the operation for feeding the cores, provided separately on other machines, to the rewinding machine, which can be found in the background art, is avoided.

Furthermore, the absence of cores also causes the absence of the dust that, in the background art, is generated by the cores in their movement inside the rewinding machine and during the rewinding operation.

Another advantage of the machine and of the method according to the invention is to allow a saving of the material used to provide the cores.

Furthermore, the rolls 70 provided with the method and the machine according to the invention have a much more uniform outer surface and much smaller tolerances than rolls provided according to the traditional technique and thus allow to achieve a higher quality for the finished roll 70.

Not least, unlike what happens with rolls provided according to the background art, once a roll provided according to the present invention is finished there is no core disposal problem.

In practice it has been found that the method and the machine according to the invention fully achieve the intended aim, since they eliminate the problems connected to the production, the provisioning, the stocking and the loading on the rewinding machine of the cores produced previously on other machines, and then allow to obtain rolls of higher quality, also eliminating the consumption of material for the production of the cores.

Although the method and the machine according to the invention have been conceived particularly for the production of coreless aluminum or aluminum alloy rolls, they may be used in any case for other materials. For example, the material for use in sheet form, instead of aluminum or aluminum alloy, may be constituted by paper material, such as for example baking paper, or synthetic material.

The method and the machine thus conceived are susceptible of numerous modifications and variations, all of which are within the scope of the appended claims; all the details may furthermore be replaced with other technically equivalent elements.

In practice, the materials used, as well as the dimensions, may be any according to the requirements and the state of the art.

The disclosures in Italian Patent Application No. 102018000006478 from which this application claims priority are incorporated herein by reference.

The invention claimed is:

1. A machine for providing rolls of material for use in sheet form, particularly aluminum for food uses, comprising:

at least one substantially cylindrical rewinding shaft, which can be actuated with a rotary motion about a longitudinal axis thereof in order to perform a step of rewinding said material for use in sheet form and means for feeding the material for use in sheet form which can be actuated in order to feed the cylindrical rewinding shaft with the material for use in sheet form to be wound;

wherein said at least one rewinding shaft comprises a plurality of cylindrical sectors which are arranged circumferentially around said longitudinal axis and form an outer lateral surface of the rewinding shaft which is configured to make contact with said material for use in sheet form during said winding step;

said cylindrical sectors comprising fixed cylindrical sectors alternated with retractable cylindrical sectors, said fixed cylindrical sectors and said retractable cylindrical sectors being mutually adjacent circumferentially along the longitudinal axis;

said retractable cylindrical sectors being able to translate radially toward and away with respect to said longitudinal axis between:

an expanded position, in which said retractable cylindrical sectors and said fixed cylindrical sectors are arranged flush, so as to form an outer lateral surface of the rewinding shaft which is cylindrical and substantially uniform and a retracted position, in which said retractable cylindrical sectors are arranged more internally with respect to said expanded position, so that longitudinal depressions are formed along said outer lateral surface of the rewinding shaft, the machine further comprising an actuation cam which is accommodated in said rewinding shaft, said actuation cam being configured to keep said retractable cylindrical sectors in said expanded position at least during said winding step, so that the winding of the material for use in sheet form occurs around the outer lateral surface when it is cylindrical and substantially uniform, wherein said actuation cam comprises a shaft which is accommodated coaxially in said rewinding shaft and is provided with conical portions which are connected mechanically to said retractable cylindrical sections; said actuation cam being axially movable with respect to said fixed cylindrical sectors in order to perform the radial movement of said retractable cylindrical sectors between said expanded position and said retracted position.

2. The machine according to claim 1, wherein said at least one rewinding shaft is provided with suction channels which are configured to make the material for use in sheet form adhere to the outer lateral surface of the rewinding shaft by means of the application of a suction flow in a radial direction toward said longitudinal axis of the rewinding shaft.

3. The machine according to claim 1, further comprising a plurality of said rewinding shafts which are supported by a revolver-like structure; processing stations being arranged around a main axis of said revolver-like structure and said revolver-like structure being able to rotate with an intermittent motion about said main axis in order to arrange, in each instance, one of said rewinding shafts at one of said processing stations.

4. The machine according to claim 3, wherein said processing stations comprise at least one rewinding station for rewinding the material for use in sheet form which is arranged sequentially around the main axis of said revolver-like structure along the direction of rotation of said revolver-like structure about said main axis.

5. The machine according to claim 4, wherein said feeder means comprise means for supporting a feed roll of material for use in sheet form and an assembly for drawing the material for use in sheet form which is arranged between said supporting means and said rewinding station; in said rewinding station there being means for cutting the material for use in sheet form.

6. The machine according to claim 3, wherein each one of said rewinding shafts is supported so that it can rotate freely about its own longitudinal axis by said revolver-like structure and can move on command along its longitudinal axis with respect to said revolver-like structure for the engagement or disengagement of an axial end thereof with a corresponding motorized tailstock and for disengagement from the roll after the rewinding of said material for use in sheet form.

7. A method for providing rolls of material for use in sheet form, particularly aluminum alloy for food uses, comprising a step of rewinding the material for use in sheet form in order to form a roll, wherein said rewinding step is provided by winding said material for use in sheet form directly on a rewinding shaft, with said material for use in sheet form in contact with a continuous cylindrical outer lateral surface of said rewinding shaft, which is actuated with a rotary motion about its longitudinal axis, so as to obtain a coreless roll, and wherein said rewinding step comprises, before the material for use in sheet form is wound at least once around said rewinding shaft, a step of radial expansion of retractable cylindrical sectors of said rewinding shaft that is adapted to define said continuous cylindrical outer lateral surface together with fixed cylindrical sectors of said rewinding shaft.

8. The method according to the claim 7, further comprising a subsequent unloading step, in which:

said retractable cylindrical sectors are moved radially toward the inside of said rewinding shaft;

the roll) obtained in the rewinding step is slid off the rewinding shaft by moving the latter along its own longitudinal axis.

9. The method according to claim 7, wherein during said rewinding step a sheet is interposed inside the first turns of said roll.

* * * * *